United States Patent [19]

Plach

[11] 4,160,530

[45] Jul. 10, 1979

[54] CORE CHUCK

[75] Inventor: Edward F. Plach, Appleton, Wis.

[73] Assignee: Appleton Machine Company, Appleton, Wis.

[21] Appl. No.: 915,812

[22] Filed: Jun. 15, 1978

[51] Int. Cl.[2] ..... B65H 17/02; B65H 75/15

[52] U.S. Cl. ..... 242/68.2; 242/22.1

[58] Field of Search ..... 242/68.2, 72, 72.1

[56] References Cited

U.S. PATENT DOCUMENTS

| | | | |
|---|---|---|---|
| 2,942,892 | 6/1960 | Nelson | 242/72.1 |
| 3,355,121 | 11/1967 | Wright | 242/68.2 |
| 3,432,112 | 3/1969 | Hardy | 242/68.2 |
| 4,079,896 | 3/1976 | Plach | 242/68.2 |

*Primary Examiner*—Edward J. McCarthy

*Attorney, Agent, or Firm*—McDougall, Hersh & Scott

[57] ABSTRACT

A core chuck is disclosed which employs a set of expandable jaw sections. The jaw sections are expandable by operation of an adjusting pinion to which the jaw sections are connected by means of a keyway element. The chuck may be attached to a shaft or bearing stand by means of an adaptor plate.

3 Claims, 5 Drawing Figures

CORE CHUCK

BACKGROUND OF THE INVENTION

This invention relates to the field of chucks for rotating cores. Hollow cores formed of paper or metal are used for winding paper and the like into rolls and similarly for unwinding supplies of such materials. Core chucks are inserted into the core and then expanded to engage the inside diameter of the core. The chucks are attached to rotating shafts which thereby permit rotation of the cores for the desired purpose.

Core chucks are not new in the art and, for example, see the patents described in the prior art section of this specification. Generally, core chucks are of two types: pneumatically expandable and tapering. The pneumatic type expands the core engaging element by use of air or hydraulic pressure. The tapering type usually employ a shoe or tapered element which is cammed into engagement with the core.

While these prior chucks are generally satisfactory, it is desirable to simplify the construction while at the same time insuring an even, firm grip on the core to prevent slipping and/or damage to the core by uneven pressure. An approach ideally suited to meet these criteria is the use of a lathe chuck mechanism in conjunction with expandable jaw sections. Such a construction would insure that the jaw sections are evenly tensioned as they expand into the core and that a tight, firm grip will be maintained on the core. Further, such a construction is relatively low in cost and simple in design rendering maintenance significantly less than with prior designs.

It is accordingly an object of the present invention to provide an improved core chuck which is highly reliable yet simple and low cost in design.

Another object of the invention is to provide a core chuck which employs a lathe chuck adjusting mechanism in conjunction with core gripping sections to accurately, firmly and evenly grip a core.

A further object of the invention is to provide a low cost core chuck suitable for use in shaftless operations wherein the drive shaft need not pass through the chuck.

Other objects and advantages of the invention will be apparent from the remaining portion of the specification.

PRIOR ART STATEMENT

In accordance with the provisions of 37 CFR § 1.97, the following is the closest prior art of which applicant is aware: U.S. Pat. No. 1,016,738 to Curry and U.S. Pat. No. 2,113,701 to Mayer. Curry discloses a chuck for the taper type in which a tapered element is cammed into and out of engagement with the inner diameter of the core by adjustment of a ring 11. Curry represents an entire class of such tapered core chucks, specific examples of which were cited as prior art against my U.S. Pat. No. 4,079,896 issued Mar. 21, 1978. Mayer discloses a chock, the use of two semi-cylindrical chock pieces 5 which are inserted into the core. The inner end of the chocks are tapered and gradually increase in overall diameter to engage the core.

DETAILED DESCRIPTION

Figure 1:
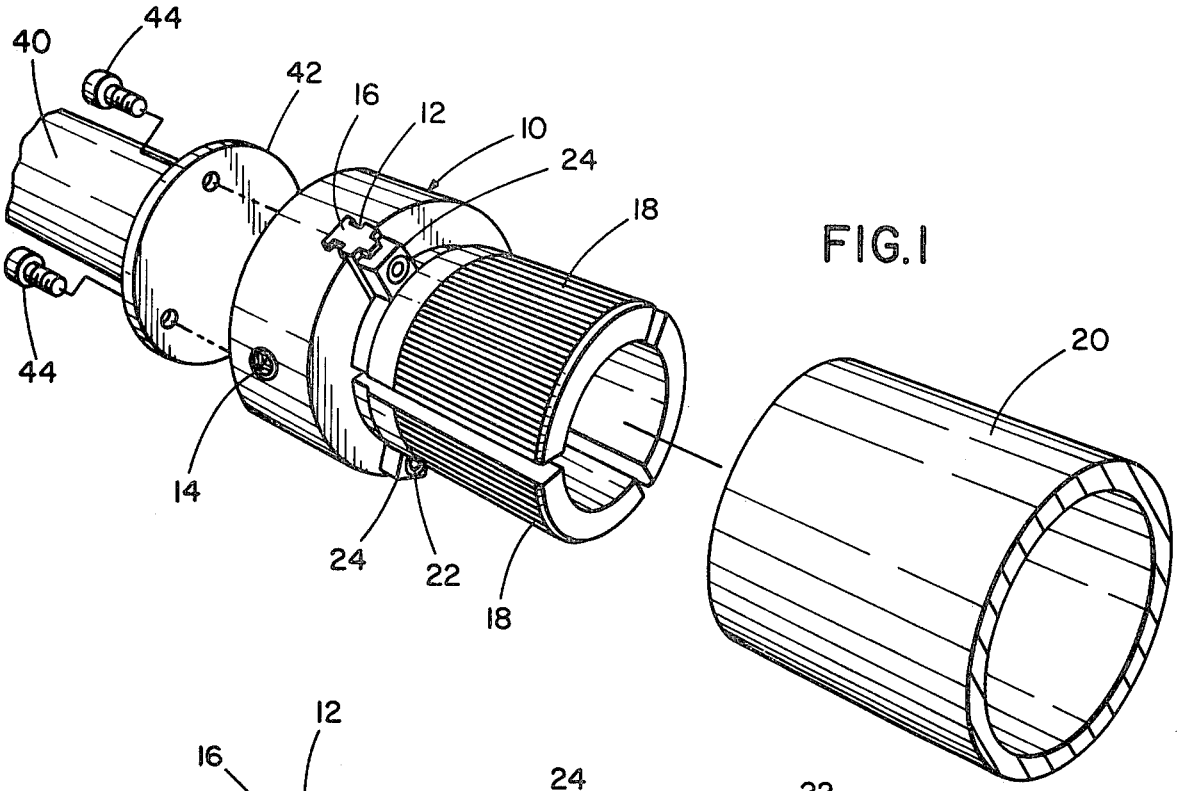
FIG. 1 is an exploded view of the core chuck illustrating the details thereof.
Figure 2:
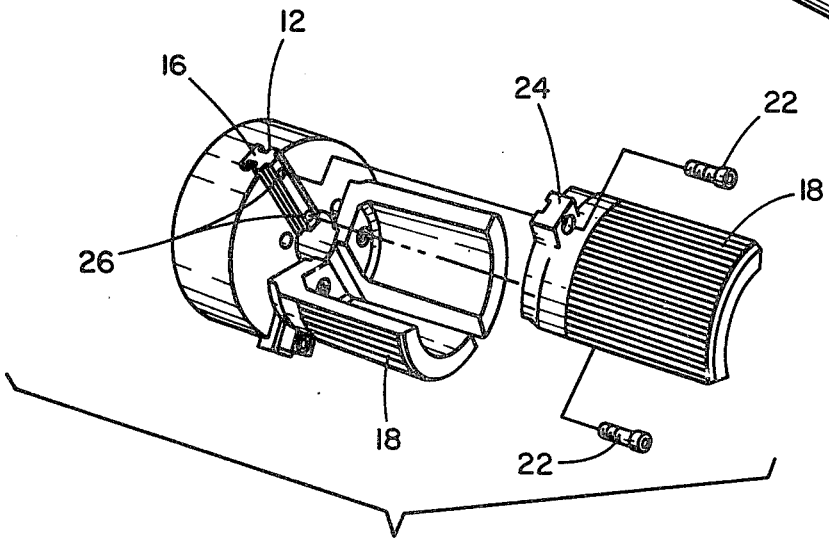
FIG. 2 is an exploded view of the core in which one of the jaw sections has been removed to show the details of the keyway element.

Referring to FIGS. 1 and 2, the core chuck includes a chuck body 10 having three radially disposed counterbored keyways 12 equally spaced around the body. The chuck body 10 is of the lathe chuck type well known in the art of metal working and wood working. Such a chuck is provided with an internal, circular plate containing screw threads thereon (not illustrated). The plate is rotated by means of adjusting pinions, such as pinion 14, spaced on the body 10. In a lathe chuck the gripping elements directly engage the threads on the circular plate and move inwardly or outwardly as a function of the adjustment of the pinion 14 which rotates the plate.

According to the present invention a lathe chuck body 10 is employed in conjunction with a keyway element 16 to which is mounted a jaw section 18. As can be seen from FIG. 1, three such keyway elements and jaw sections are employed to form a split ring expandable gripping surface for engaging the inner diameter of a core 20. Obviously two sections or more than three sections could be employed if desired. As shown in FIG. 2, each keyway element 16 is secured to a corresponding jaw section 18 by means of bolts 22 which pass through securing tabs 24 and into threaded holes 26. Thus, each jaw section 18 is secured to a keyway element 16 for movement therewith.

Figure 2A:
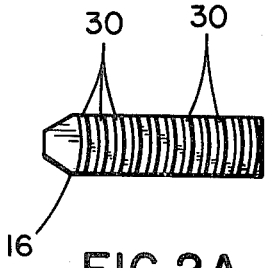
FIG. 2A is a bottom plan view of the keyway element.

The keyway elements, as illustrated in FIG. 2A, are provided with a plurality of raised segments 30. These segments function as threads for engaging the threads on the circular plate of the chuck body 10. Element 16 is dimensioned to fit the counterbore 12 of the chuck body to permit the necessary movement of the jaw sections when the pinion 14 is rotated.

Figure 3:
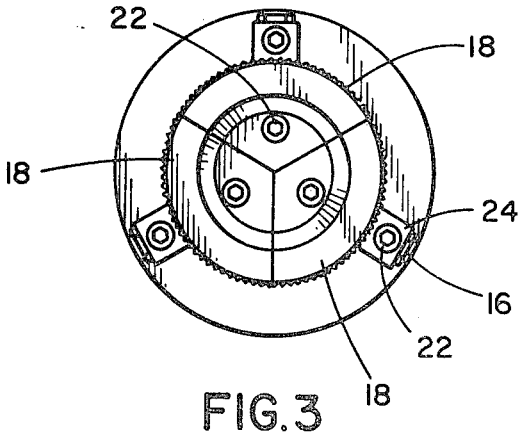
FIG. 3 is an elevational view of the chuck in which the jaw sections are completely closed.
Figure 4:
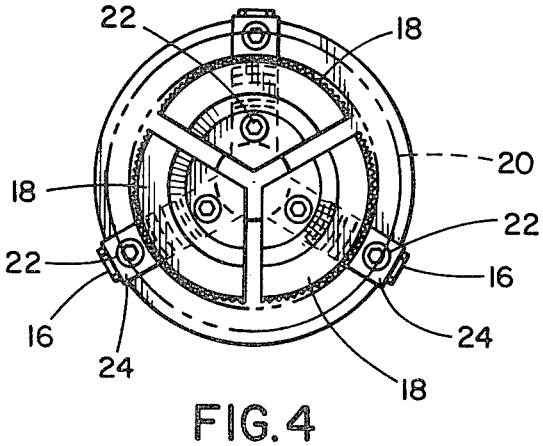
FIG. 4 is a view similar to FIG. 3 in which the jaws are sufficiently open to engage the inner circumference of a core.

Referring to FIGS. 3 and 4, the manner of securing the core chuck to the core 20 will be readily apparent. The pinion 14 is rotated in a first direction in order to draw the jaw sections 18 to their innermost position illustrated in FIG. 3. As the pinion rotates it, in turn, rotates the circular plate of the chuck body 10 and moves the keyway elements. In the FIG. 3 position the segments form a minimum diameter circular element which is readily receivable inside the core. The jaw sections are then inserted into the core and the pinion 14 rotated in the opposite direction. The result is shown in FIG. 4. The jaw segments are equally and accurately moved from their initial positions to positions where each segment engages the inner diameter of the core. Gripping of the core is enhanced by providing knurling on the outer surface of the sections 18. The accurate positioning of each of the three sections is insured by virtue of the pinion and circular plate mechanism which affirmatively positions each jaw section as a function of the number of turns of the adjusting pinion.

The core chuck disclosed herein is of the "shaftless" type used when it is not necessary for the drive shaft to pass through the chuck. Under these circumstances the chuck will be attached to a shaft as, for example, shaft 40 illustrated in FIG. 1, by means of an adaptor plate 42 and bolts 44. Alternately, the chuck can be attached to a bearing stand where, for example, it is desired to support the core on the side opposite the drive shaft. In that case a similar adaptor plate would be employed which, in turn, would be connected to the bearing stand.

It is to be emphasized that a principal feature of the invention is the ability to precisely control the movement of the jaw sections. This is accomplished by securing them to the keyway elements 16 which are engaged by the threads of the circular plate incorporated in the lathe chuck body and rotatable via pinions 14. Once the core chuck, according to the invention, has been correctly assembled and adjusted to achieve the precise fit illustrated in FIG. 3, that relationship will be maintained during all subsequent use of the chuck since the sections are, in effect, locked one to the other by virtue of their being engaged to the same threaded circular plate.

While I have shown and described embodiments of this invention in some detail, it will be understood that this description and illustrations are offered merely by way of example, and that the invention is to be limited in scope only by the appended claims.

I claim:

1. A core chuck comprising:

(a) a chuck body of the lathe chuck type including a rotatable circular plate containing screw threads on one surface thereof and at least one adjustable pinion engaging said plate to control rotation of the plate, (b) at least two counterbored, radially aligned keyways formed in said body permitting access to said threaded surface of said plate, (c) a keyway element disposed in each of said keyways and in contact with said plate, said element including a plurality of raised segments on the plate side of said element for interengaging the screw threads on said plate, whereby the keyway element may be accurately positioned at a desired location within said keyway by rotation of said pinion, (d) jaw sections secured to the side of said keyway element remote from said plate for movement therewith, said jaw sections, in combination with each other, forming a split ring expandable gripping surface, cylindrical in cross-section and adapted to be inserted into a core and then expanded to permit each jaw section to securely engage the inner diameter of said core as function of rotation of said pinion.

2. A core chuck according to claim 1 wherein said core chuck includes three keyways and jaw sections.

3. A core chuck according to claim 1 wherein said jaw sections are knurled on their outer surface to improve the grip on said core.

* * * * *